United States Patent [19]

Krejcik

[11] Patent Number: 4,485,916

[45] Date of Patent: Dec. 4, 1984

[54] SAFETY ARRANGEMENT FOR PRECIOUS OBJECTS

[76] Inventor: Peter Krejcik, Dominikanerbastei 5, Vienna, Austria, A-1010

[21] Appl. No.: 518,765

[22] Filed: Aug. 1, 1983

Related U.S. Application Data

[63] Continuation of Ser. No. 285,067, Jul. 20, 1981, abandoned.

[30] Foreign Application Priority Data

Jul. 18, 1980 [AT] Austria ..... 3745/80
Dec. 11, 1980 [AT] Austria ..... 6033/80

[51] Int. Cl.[3] ..... A45C 11/16
[52] U.S. Cl. ..... 206/45.34; 206/45.14
[58] Field of Search ..... 63/26, 29 R, 29 M, 30; 206/1.5, 0.83, 37, 45.14, 45.15, 45.17, 807, 45.34

[56] References Cited

U.S. PATENT DOCUMENTS 988,191 3/1911 Heidtmann ..... 206/1.5
2,144,336 1/1939 Katz ..... 206/45.19
2,874,828 2/1959 Neugeberger ..... 206/45.15
3,155,236 11/1964 Reno ..... 206/45.34
3,957,157 5/1976 Therrien ..... 206/0.83
4,275,810 6/1981 Waldmeier ..... 206/45.34
4,320,831 3/1982 Szabo ..... 206/45.34

FOREIGN PATENT DOCUMENTS 2522101 11/1976 Fed. Rep. of Germany ... 206/45.34
2913372 10/1979 Fed. Rep. of Germany ..... 63/29 R
2421818 2/1979 France .
659669 10/1951 United Kingdom ..... 63/30

*Primary Examiner*—F. Barry Shay
*Attorney, Agent, or Firm*—Kurt Kelman

[57] ABSTRACT

Safety device for holding and storing precious objects, coins and other rigid valuables, wherein at least two parts (1,2;13,14) displaceable in relation to each other are provided and the two parts are secured against displacement for release of the valuable (5) by a preferably sealable lock in a position in which the parts at least partially encompass the valuable.

4 Claims, 2 Drawing Figures

SAFETY ARRANGEMENT FOR PRECIOUS OBJECTS

Figure 1:
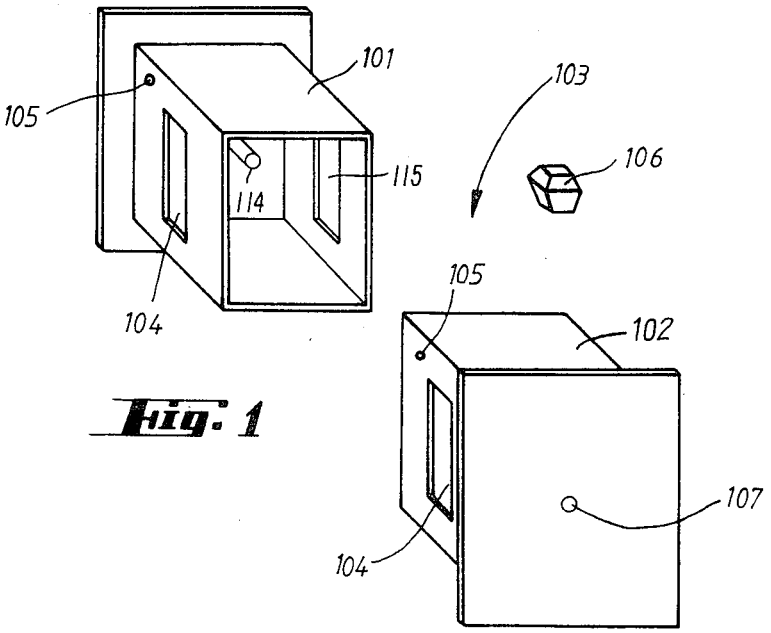

This is a continuation of application Ser. No. 285,067, filed July 20, 1981 now abandoned.

The invention relates to a safety device for holding and storing precious objects, coins and other rigid valuables.

It is the object of the invention to provide a device which permits an unhindered appraisal of the valuable but excludes the possibility of removing the valuable without destroying a lock or seal. According to the invention, the valuable secured by the device is retained with simple means.

This is achieved according to the invention with at least two housing parts displaceable in relation to each other and the two parts housing are secured against displacement for release of the valuable by a sealable lock in a position in which the parts housing at least partially encompass the valuable.

It is a further object of the invention to provide a receptacle permitting an accurate subsequent appraisal, including weighing of the valuable object, wherein the relatively displaceable housing parts are constituted by receptacle halves which may be sealed in the closed condition wherein the halves at least partially overlap, at least one of the receptacle halves having a sight hole or being of a transparent, preferably glassy, material, and that at least one opening dimensioned to match the size of the object to be stored in the receptacle remains when the receptacle is closed, the diameter of the largest inscribed circle delimited by the rims of the opening being smaller than the diameter of the largest sphere inscribed in the object to be stored in the receptacle. This enables the object enclosed in the receptacle to be visually appraised while being seized or held with a tool. This makes it possible, for example, to examine diamonds. Furthermore, it is also possible to weigh the enclosed object. For this purpose, it is sufficient to introduce a plunger through an opening of the receptacle to support the object and to hold the receptacle so that the object rests solely on the plunger supported on a scale.

A preferred modification of such an embodiment is characterized in that the receptacle halves are made of a material which cannot be welded or can be welded only with difficulty or only at very high temperatures, such as, for example, polystyrene, polycarbonate, modified polystyrene, or glass. In this manner, it is not only possible to appraise the object enclosed in the receptacle preferably made of a transparent, especially glassy, material but also to prevent fraudulent manipulation, for instance by enlarging the opening, removing and replacing the enclosed object and subsequently decreasing the opening to its original size. This would cause a clearly visible change in the light refraction along the interfaces between the material of the receptacle and that of the material applied thereto or such a high temperature would be required to weld the material thereto that the encased object, for example a diamond or a gold coin, could not be protected against damage or destruction. This would be the case, for instance, with receptacles of glass, in which instance the receptacle in all likelihood would burst so that the manipulation would become evident.

To enable the object enclosed in the receptacle to be fixed, it is advantageous to provide a fixing arrangement, for example a screw or spring, in the interior of the receptacle halves. In this connection, it may be usefully provided that the shape of the opening of the receptacle and, optionally, also the inclination of the walls defining the opening correspond to the shape of the object to be received, for example a diamond.

A particularly preferred embodiment of the invention is characterized in that a magnifying glass is inserted and fixed in the wall of one of the receptacle halves. In this manner, a very accurate visual control of the enclosed object is possible.

Figure 2:
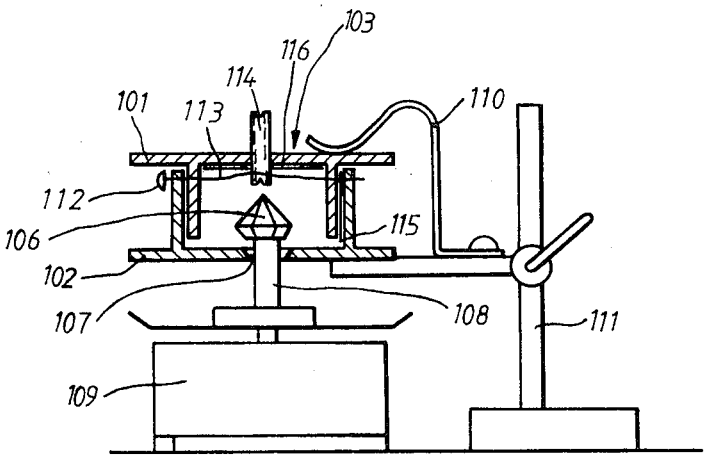

The invention will now be described in more detail with reference to the drawings wherein FIG. 1 shows a perspective view of the two halves of a receptacle according to the invention, and FIG. 2 shows an example of a manipulation of the object enclosed in the receptacle of FIG. 1.

In the illustrated embodiment, the two housing parts are constituted by halves 101 and 102 of receptacle 103 and may be telescopingly inserted into each other whereby they are movable into a closed position to encompass a chamber for holding and storing object 106, as shown in FIG. 2. Housing parts 101, 102 are made of a glass-clear material, such as polystyrene, polycarbonate, modified polystyrene, or glass, which is difficult to weld and, if welded create a clearly different light refraction in the transition zone. Both halves 101, 102 define an opening 104. These openings 104 are in registry when receptacle half 101 is fully inserted into receptacle half 102 so that openings 104 remain open also when receptacle 103 has been closed.

Bores 105 defined in their side walls also register when receptacle halves 101 and 102 are fully telescoped into each other. It is possible to thread a thread or wire through these bores and like bores defined in the opposite side walls and to secure it with a seal 112, as illustrated in FIG. 2. Since openings 104 of receptacle 103 are so dimensioned that the diameter of the largest inscribed circle delimited by the rims of opening 104 is smaller than the diameter of the largest sphere inscribed in object 106 to be stored in receptacle 103, object 106 cannot be removed from closed receptacle 103 without damaging the seal. On the other hand, it is possible to manipulate enclosed object 106, for example a precious stone, with a tool, for example assaying tongs, introduced through opening 104 into receptacle 103 or to weigh it, as illustrated in FIG. 2.

FIG. 2 shows the weighing of object 106, that is a precious stone, enclosed in a receptacle 103 according to the invention. It is supported on plunger 108 of known weight which projects into the interior or receptacle 103 through opening 107 in the bottom of receptacle half 102 and rests on scale 109. Receptacle 103 is clamped in mounting support 110 which is constituted by an arm and a spring affixed thereto and which is vertically movably guided along a column 11 and may be fixed in position. This makes it possible so to adjust receptacle 103 that object 106 is supported solely by plunger 108 and its weight may thus be ascertained.

Thread or wire 113 threaded through bores 105 defined in the side walls of receptacle halves 101, 102 and secured by seal 112 is also visible in FIG. 2.

In the embodiment of receptacle 103 shown in FIG. 2, screw 114 is provided for clamping object 106 enclosed by receptacle 103 in position. Furthermore, the side walls opening 107 are inclined so as to match the shape of object 106 to be received in receptacle 103.

This enables the object to be securely fixed in position with very small pressure forces exerted thereupon.

In the embodiment according to FIG. 2, a microfilm or magnetic card 115 or the like is inserted between one of the side walls of the two receptacle halves 101 and 102, on which may be copied or stored an appraisal, for example, of object 106 contained in receptacle 103. In case of a magnetic card, the information stored thereon may be especially easily retrieved. For this purpose, the receptacle only needs to be passed by a reading head. It is possible, of course, to provide on the inside of a side wall of a receptacle half 101, 102 ledges for insertion of the microfilm or magnetic card 116.

To make object 106 contained in receptacle 103 more readily recognizable, if need be, the inner wall of one receptacle half may be lined with a film, for example a reflecting film 116.

Although only one elongated opening 104 is shown in FIG. 1 in a side wall of a receptacle half 101 and 102, it is, of course, possible to provide several openings and to make the same circular, arcuate or elliptical. It is essential, however, that the largest inscribed circle delimited by the rims of the opening has a smaller diameter than the largest sphere inscribed in the object to be received.

The shape of receptacle 103 may also be selected freely. For example, it may also have a round cross section and the two halves may be screwed together or they may be connectable by means of a bayonet joint.

Seal 112 may be lead or wax seal.

The two receptacle halves may be secured against unauthorized opening by a ribbon provided with a decorative seal and, optionally, an eyelet may be provided so that the receptacle with its content may be worn as a pendant.

I claim:

1. A safety device for holding and storing a rigid valuable object, which comprises (a) a valuable object, (b) two housing parts movable into a closed position to encompass a chamber for holding and storing the object, the housing parts being at least partially of a transparent material to allow visual inspection of the valuable object in the chamber, the transparent material being weldable only at very high temperatures, (1) said housing parts defining an opening means permitting physical access to the object from outside the parts when the parts are in the closed position, the opening means including an opening having an axis extending perpendicularly to the housing parts and being dimensioned so that the diameter of the largest circle inscribable in the opening about said axis is smaller than the diameter of the largest sphere inscribable in the object within the confines of said chamber; and (c) a sealable lock securing the two housing parts on the closed position.

2. The safety device of claim 2, further comprising a holding device in the chamber for clamping the rigid valuable object to store it securely in the chamber.

3. The safety device of claim 2, wherein the holding device includes a clamping part adjustable relative to the housing parts for holding the object along the opening axis in the closed position of the two housing parts.

4. The safety device of claim 3, wherein the two housing parts are telescopingly interengaging housing halves and the clamping part is a screw mounted in the other housing part in alignment with the vertical axis of the opening in the one housing part.

* * * * *